US008082844B1

(12) United States Patent
Barker et al.

(10) Patent No.: US 8,082,844 B1
(45) Date of Patent: Dec. 27, 2011

(54) ACOUSTIC CRYSTAL EXPLOSIVES

(75) Inventors: Delmar L. Barker, Tucson, AZ (US); Kenneth L. Moore, Sahuarita, AZ (US); William R. Owens, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 335 days.

(21) Appl. No.: 12/473,275

(22) Filed: May 28, 2009

(51) Int. Cl.
*F42D 5/045* (2006.01)

(52) U.S. Cl. ..... 102/200

(58) Field of Classification Search ..... 102/200, 102/305, 308–310, 320, 389, 394, 492, 494, 102/506, 217, 202.1, 202.2
See application file for complete search history.

(56) References Cited

U.S. PATENT DOCUMENTS

| | | | | |
|---|---|---|---|---|
| 4,145,972 | A | 3/1979 | Menz | |
| 4,325,304 | A * | 4/1982 | Ormiston | 102/200 |
| 4,475,461 | A * | 10/1984 | Durrell | 102/200 |
| 4,899,663 | A * | 2/1990 | Thorn | 102/530 |
| 4,976,199 | A * | 12/1990 | Beukes et al. | 102/200 |
| 5,182,418 | A | 1/1993 | Talley | |
| 5,375,527 | A * | 12/1994 | Nakajima | 102/301 |
| 5,388,521 | A * | 2/1995 | Coursen | 102/311 |
| 6,744,552 | B2 | 6/2004 | Scalora | |
| 6,809,856 | B2 | 10/2004 | Reed | |
| 7,078,697 | B2 | 7/2006 | Barker | |
| 7,079,308 | B2 | 7/2006 | Reed | |
| 7,116,458 | B2 | 10/2006 | Reed | |
| 7,257,333 | B2 | 8/2007 | Rosenwald | |
| 7,292,740 | B1 * | 11/2007 | Barker et al. | 385/7 |
| 7,418,373 | B2 * | 8/2008 | Heck, Sr. | 703/10 |
| 7,886,667 | B1 * | 2/2011 | Baker et al. | 102/495 |
| 2003/0183109 | A1 * | 10/2003 | Rudhard et al. | 102/200 |
| 2005/0016407 | A1 * | 1/2005 | Bernard | 102/200 |
| 2008/0282925 | A1 * | 11/2008 | Lownds et al. | 102/311 |

OTHER PUBLICATIONS

Florian Beil "Shock waves in nanomechanical Resonators" Cond-mat.mes-hall Aug. 14, 2007.
Veronica Eliasson "On focusing of shock waves" Technical Reports from Royal Institutre of Technology Sep. 2007.
Benjamin Hooberman "Everything you ever wanted to know about frequency-selective surface filters but were afraid to ask" May 2005.
C. Lopez "Materials Aspects of Photonic Crystals" Advanced Materials 15, 1679 (2003).
Zhi-Yuan Li "Modified thermal radiation in three-dimension photonic crystals" Phys. Rev. B 66, R241103 (2002).
Shawn-Yu Lin "Enhancement and suppression of thermal emission by a three-dimensional photonic crystal" Phys. Rev. B. 62, R2243 (2000).

(Continued)

*Primary Examiner* — Bret Hayes
*Assistant Examiner* — Reginald Tillman, Jr.
(74) *Attorney, Agent, or Firm* — Eric A. Gifford

(57) ABSTRACT

An acoustic crystal explosive, which gains its properties from both its periodic structure and its composition, may be configured to suppress or enhance the sensitivity of detonation of the explosive in response to an acoustic wave. An explosive material and a medium (explosive or inactive) are arranged in a periodic array that provides local contrast modulation of the acoustic index to define a band gap in the acoustic transmission spectrum of the explosive materials. At least one defect cavity in the periodic array creates a resonance in the band gap. The defect cavity concentrates energy from an incident acoustic (shock) wave to detonate the explosive. Multiple defect cavities may be configured to provide a desired shaped charge or volumetric detonations. Means may be provided to reprogram the defect cavity(ies) to reconfigure the explosive.

31 Claims, 6 Drawing Sheets

OTHER PUBLICATIONS

E.J. Reed "Color of shock waves in photonic crystals" Physical Review Letters 90, 203904 (2003a).

E.J. Reed "Reversed Doppler Effect in Photonic Crystals" Physical Review Letters 91, 133901 (2003b).

* cited by examiner

ACOUSTIC CRYSTAL EXPLOSIVES

BACKGROUND OF THE INVENTION

1. Field of the Invention

This invention relates to explosives, and more particularly to acoustic crystal explosives.

2. Description of the Related Art

An explosive material is a material that either is chemically or otherwise energetically unstable or produces a sudden expansion of the material usually accompanied by the production of heat and large changes in pressure (and typically also a flash and/or loud noise) upon initiation; this is called the explosion or detonation.

A chemical explosive is a compound or mixture which, upon the application of heat or shock, decomposes or rearranges with extreme rapidity, yielding much gas and heat. A reaction must be capable of being initiated by the application of a shock wave or heat to a small portion of the mass of the explosive material. A detonation wave is essentially a shock wave supported by a trailing exothermic reaction. Detonation involves a wave traveling through a highly combustible or chemically unstable medium, such as an oxygen-methane mixture or a high explosive. The chemical reaction of the medium occurs following the shock wave, and the chemical energy of the reaction drives the wave forward.

Primary explosives are extremely sensitive to mechanical shock, friction, and heat, to which they will respond by burning rapidly or detonating. Examples include mercury fulminate, lead styphnate and lead azide. Primary explosives are easy to initiate but inherently less stable. Secondary explosives, also called base explosives, are relatively insensitive to shock, friction, and heat. They may burn when exposed to heat or flame in small, unconfined quantities, but detonation can occur. These are sometimes added in small amounts to blasting caps to boost their power. Dynamite, TNT, RDX, PETN, HMX, and others are secondary explosives. PETN is the benchmark compound; compounds more sensitive than PETN are classed as primary explosives. Secondary explosives are inherently more stable but hard to initiate. Often a primary explosive or "booster" is used to produce a shock wave with sufficient intensity to detonate the main charge of secondary explosives. Many customers would like to eliminate the use of primary explosives and use only secondary explosives.

Explosive force is released in a direction perpendicular to the surface of the explosive. If the surface is cut or shaped or "lensed", the explosive forces can be focused to produce a greater local effect; this is known as a "shaped charge". Multipoint initiation may be used to approximate a volumetric detonation. Achieving a desired shaped charge or a volumetric detonation is typically very expensive using known techniques.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides an acoustic crystal explosive that gains its properties from both its periodic structure and its composition. The explosive may be configured to suppress or enhance the sensitivity of detonation of the explosive in response to an acoustic wave. The explosive may be configured to eliminate the need for primary explosives, using only secondary explosives. The acoustic crystal explosive may provide a cost-effective solution for volumetric or shaped-charge detonation. The acoustic crystal explosive may be reprogrammed to provide a configurable explosive.

In an enhancement mode embodiment, an acoustic crystal explosive comprises an explosive material having a first acoustic index and a medium having a second acoustic index different than the first acoustic index. The explosive material and the medium are arranged in a periodic array that provides local contrast modulation of the acoustic index of the explosive in at least one dimension to define a band gap in the acoustic transmission spectrum of the explosive materials. At least one defect cavity in the periodic array creates a resonance in the band gap. The defect cavity concentrates energy from an incident acoustic (shock) wave to detonate the explosive. Without the periodic structure and defect cavity to concentrate energy, the acoustic (shock) wave may be too weak to detonate the explosive. Multiple defect cavities may be configured to provide a desired shaped charge or volumetric detonations. Means may be provided to reprogram the defect cavity(ies) to reconfigure the explosive either offline or in real-time In a suppression mode embodiment, an acoustic crystal explosive comprises an explosive material having a first acoustic index and a medium having a second acoustic index different than the first acoustic index. The explosive material and the medium are arranged in a periodic array that provides local contrast modulation of the acoustic index of the explosive in at least one dimension to define a band gap in the transmission spectrum of the explosive materials. The band gap reflects energy from an incident shock wave to suppress detonation of the explosive. Suppression mode may be useful for preventing accidental or malicious detonation of the explosive from an external shock wave. An initiation source could be placed inside the explosive for controlled detonation. Alternately, means can be provided to reconfigure the periodic array to introduce one or more defect cavities to switch from suppression to enhancement modes when detonation is desired.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
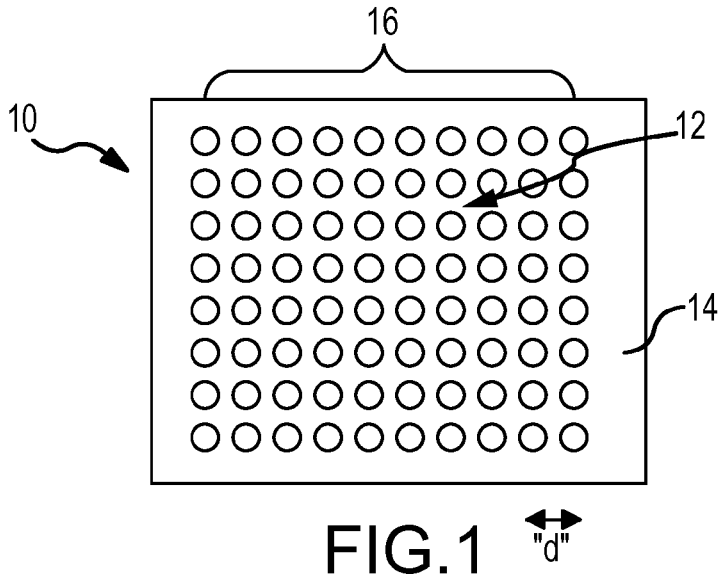
FIG. 1 is a plan view of an acoustic crystal explosive.

As described above, explosive detonation can be initiated by the application of a shock wave to the explosive. The transmission properties of most explosives are such that shock waves propagate through the explosive and if sufficiently intense initiate detonation. The intensity of the shock wave required to initiate detonation can be both a plus and minus. Primary explosives are easy to intentionally detonate (plus) but are also susceptible to unintentional (environmental, accidental or malicious) detonations and provide less explosive power (minus). Secondary explosives are more difficult to intentionally detonate (minus) but less susceptible to unintentional detonations and provide more explosive power (plus). The use of a primary explosive to initiate detonation of the secondary explosive is a common technique to address some of these issues. However, primary explosives are less stable and customers would like to eliminate their use in many applications. To effect a volumetric or space-charge detonation requires multi-point initiation or explosive lenses, which are expensive and limited in effectiveness.

The 'acoustic crystal explosive', which gains its properties from both its periodic structure and its composition, may overcome these challenges in a cost-effective manner. The acoustic crystal explosive may be configured to initiate secondary explosives directly, eliminating the need for primary explosives. The acoustic crystal explosive can be programmed, and potentially reprogrammed, to provide volumetric detonation or a desired shaped-charge detonation. Essentially the 'acoustic crystal explosive' is a periodic array that provides local contrast modulation of the acoustic index of an explosive in at least one dimension. This modulation defines a band gap in the transmission spectrum of the explosive material. The periodic structures are of similar size to the central wavelength of the band gap. By itself the band gap reflects energy from an acoustic or shock wave and tends to suppress detonation. The creation of one or more defect cavities in the periodic array creates a resonance in the band gap that tends to concentrate energy from the acoustic or shock wave to initiate detonation of the explosive. This 'enhancement' allows for the elimination of the primary explosives if so desired. Furthermore, the defect cavities can be configured (or reprogrammed) for volumetric or shaped-charge detonation.

As used herein an 'acoustic wave' refers to a pressure fluctuation that travels through a medium (solid, liquid or gas) at or near the speed of sound. A 'shock wave' is an acoustic wave that is traveling faster than the speed of sound in the medium. Shock waves are typically characterized by an abrupt, nearly discontinuous change in the characteristics of the medium. Across a shock there is an extremely rapid rise in pressure, temperature and density of the flow. A 'detonation wave' is a shock wave that is supported by a trailing exothermic reaction in a combustible or chemically unstable medium that drives the wave forward.

As shown in FIG. 1, an acoustic crystal explosive 10 includes an explosive material 12 having a first acoustic index and a medium 14 having a second acoustic index different than said first acoustic index. The explosive material may be a solid, liquid or gas. The medium may be a solid, liquid or gas and may be either a different explosive material or a non-explosive (inactive) material. In this example, the medium is a 'slab' and the explosive materials are 'rods' spaced in a periodic arrangement in the slab. Alternately, the explosive material may be the slab and the medium the rods. The explosive material may be a Primary, Secondary or other explosive. If both the explosive material and the medium are explosives, they may both be Primary explosives, Secondary explosives or a Primary and Secondary explosive or other.

Figure 2:
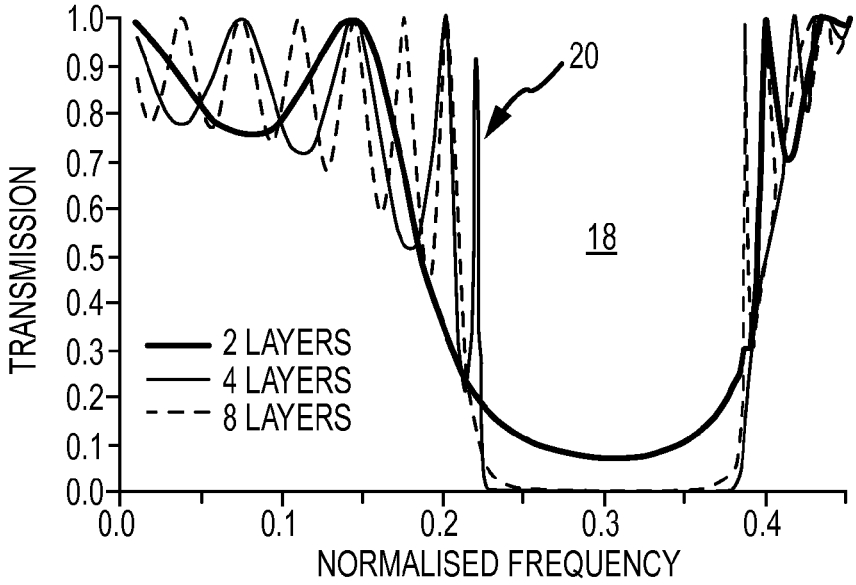
FIG. 2 is a plot of the transmission response including a band gap.

The explosive material 12 and medium 14 are arranged in a periodic array 16 that provides local contrast modulation of the acoustic index of the explosive in at least one dimension. A 2-D array as shown provides modulation in 1-D. A 3-D array would provide modulation in 2-D. A local contrast modulation of at least 1.5 for a 2-D array and 2.0 for a 3-D array creates a 'band gap' 18 in the acoustic transmission spectrum 20 of the explosive material as shown in FIG. 2. The wavelength at the center of the band gap is approximately equal to or at least on the order of the spacing 'd' in the periodic array. The material can be actively controlled to open or close the band gap, or shift the edges of the band gap. This can be accomplished by modulating the contrast of the acoustic indices, changing the geometric arrangement or altering the symmetry of the scattering objects. Outside the band gap the energy in an acoustic wave operationally coupled to the periodic array will be transmitted through and partially absorbed by the explosive material. Inside the band gap the energy in the acoustic wave will constructively interfere and be largely reflected. The more rows or layers to the periodic array the better defined the band gap 18 in the acoustic transmission spectrum 20.

The 'acoustic index' is defined as the ratio of the speed of sound in a control medium to the speed of sound in the material of interest. We have selected diamond as the control medium although any medium can be used. When computing the contrast or local modulation of the acoustic index the control medium cancels out leaving only the properties of the explosive materials and medium. Table 1 lists a number of explosive materials, the speed of sound in the material and acoustic indices.

TABLE 1

| Material | m/sec | Acoustic Index |
|---|---|---|
| Diamond | 12000 | 1.00 |
| Air (20 C.) | 1,125 | 10.67 |
| Aluminum | 4877 | 2.46 |
| Brass | 3475 | 3.45 |
| Copper | 3901 | 3.08 |
| Iron | 5130 | 3.08 |
| Lead | 1158 | 10.36 |
| Steel | 6100 | 1.97 |
| Water | 1433 | 8.37 |
| Nitroglycerine | 2200 | 5.45 |
| PETN | 1450 | 8.28 |
| Cyclonite | 2300 | 5.22 |
| Tetryl | 1500 | 8.00 |
| PBXW 115 | 5642 | 2.13 |
| PBXN 111 | 5760 | 2.08 |
| Composition H-6 | 7368 | 1.63 |
| Composition B | 7879 | 1.52 |

As depicted there are many combinations of materials explosive-explosive or explosive-inactive that provide a local contrast modulation (index1/index2) of greater than 1.5 or greater than 2.0. For example, an array formed of PETN and aluminum provides a local contrast modulation of 8.28/

2.46=3.45. An array formed of two different explosive compounds PETN and PBXN111 provides a local contrast modulation of 8.28/2.08=3.98.

The acoustic crystal explosive 10 may be useful for preventing accidental or malicious detonation of the explosive from an external shock wave. On account of the availability of materials with large differences in acoustic index, the width of the band gap is fairly large, approximately 20% to 70% of the center wavelength. As such, the band gap may effectively suppress initiation of the explosive from an external shock wave. Because an external shock wave may penetrate 1 or 2 rows before being reflected, if suppression is desired the explosive material in the outer couple rows may be replaced with an inactive material of the same or similar acoustic index to avoid initiating detonation around the periphery. An initiation source (shock or temperature) could be placed inside the explosive for controlled detonation. Alternately, means can be provided to reconfigure the periodic array to introduce one or more defect cavities to switch from suppression to enhancement modes when detonation is desired.

Figure 3:
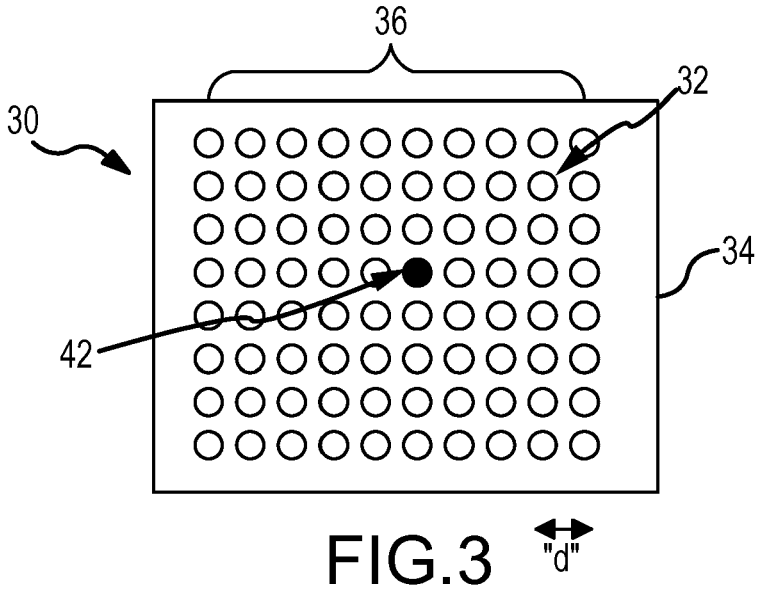
FIG. 3 is a plan view of an acoustic crystal explosive including a defect cavity.
Figure 4:
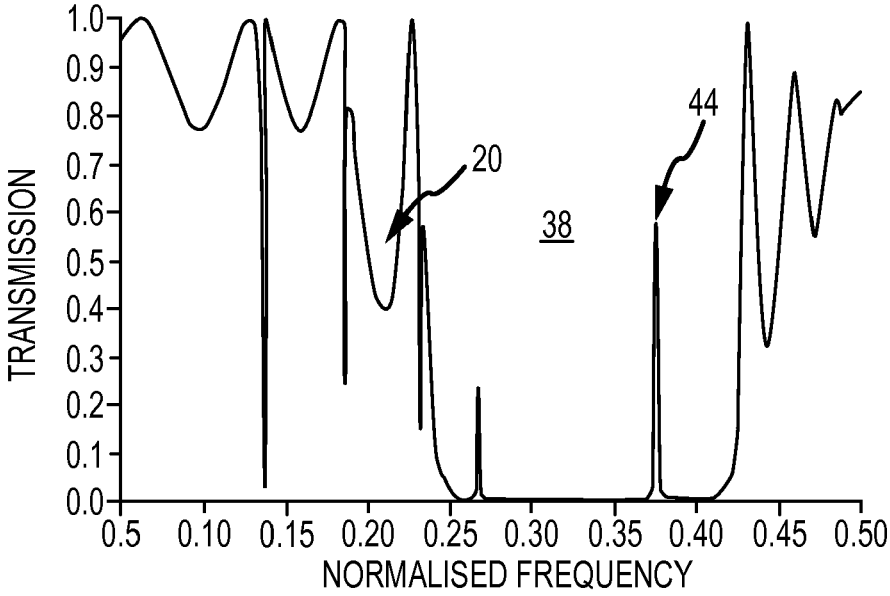
FIG. 4 is a plot of a resonant peak in the band gap of transmission response associated with the presence of the defect cavity.

As shown in FIG. 3, an acoustic crystal explosive 30 includes an explosive material 32 having a first acoustic index and a medium 34 having a second acoustic index different than said first acoustic index. The explosive material 32 and medium 34 are arranged in a periodic array 36 that provides local contrast modulation of the acoustic index of the explosive in at least one dimension. A local contrast modulation of at least 1.5 for a 2-D array and 2.0 for a 3-D array creates a 'band gap' 38 in the acoustic transmission spectrum 40 of the explosive material as shown in FIG. 4. A defect cavity 42 in the periodic array creates a transmission resonance 44 within band gap 38. The defect cavity may be any significant disturbance or "defect" in the periodic structure e.g. the absence of explosive material 34, different geometry of the same explosive material 34 or a different explosive or non-explosive material. Techniques to construct high-Q defect cavities are well-known. The "Q" indicates how well the defect cavity resonates over many cycles of the acoustic wave to concentrate and reach a non-linear effect to initiate detonation. Graded cavities are known to provide high Q.

If an acoustic (shock) wave is operatively coupled to the explosive with frequency content that overlaps the band gap and particularly the resonance, the defect cavity will concentrate energy from the wave at the defect for some number of cycles. The effect may be to create a hot or high-pressure spot sufficient to initiate detonation of the explosive material near the spot. As will be detailed below, this phenomenon can be useful to initiate detonation of the explosive material using a relatively weak acoustic or shock wave, to directly initiate secondary explosive material without the use of primaries, to control the location of initiation within the explosive, to achieve volumetric detonation, to produce a shape-charged detonation and to reprogram the one or more defect cavities for some or all of the above.

Figure 5:
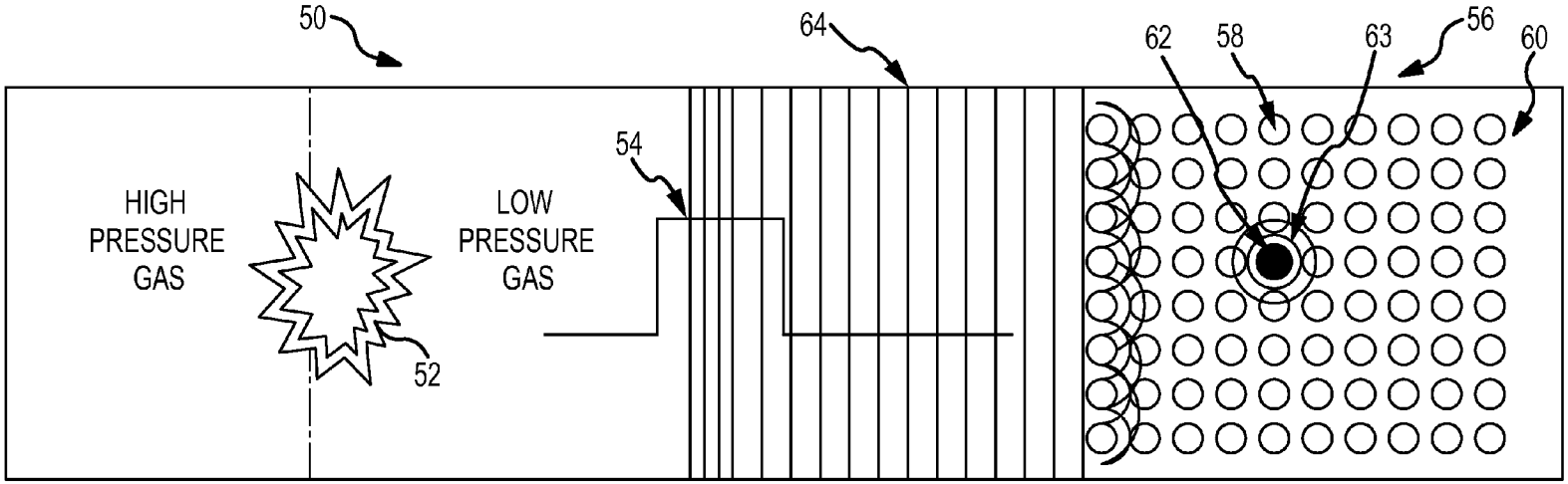
FIG. 5 is an embodiment of an enhancement-mode acoustic crystal explosive.

As shown in FIG. 5, an embodiment of an explosive 50 includes a source 52 of an acoustic wave 54 (in this case a shock wave), an acoustic explosive material 56 including an explosive 58 and a medium 60 configured in a periodic array to produce a local modulation of the acoustic index and at least one defect cavity 62 in the array and an impedance-matched medium 64 to operatively couple the acoustic wave 66 to the acoustic explosive material. Defect cavity 63 concentrates and resonates energy 63 to trigger the surrounding explosive 58. The impedance-matching medium may not be required but is useful to limit coupling losses. Source 52 may be a primary explosive or another shock producing phenomenon like a laser pulse, a bursting diaphragm, a mechanical transducer and shock tube etc. to produce wave 54 as shown in FIG. 6*a*. Shock wave 54 is characterized by an abrupt, nearly discontinuous change in the characteristics of the medium. Across a shock there is an extremely rapid rise in pressure, temperature and density of the flow.

Figure 6B:
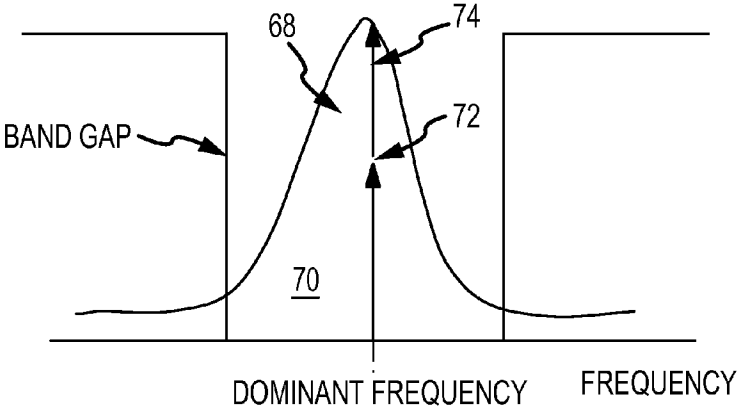
FIGS. 6*a* and 6*b* are plots of a shockwave and the frequency response of the shockwave overlaid on the band gap and defect cavity resonance.
Figure 6A:
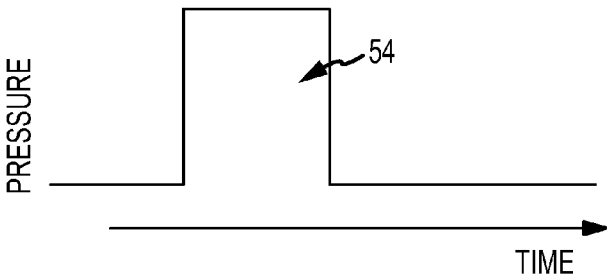

As shown in FIG. 6*b*, the frequency content 68 of wave 54 in the medium overlaps the band gap 70 and particularly the resonance 72 created by the acoustic crystal explosive. In this embodiment, dominant frequency 74 of the acoustic wave 54 is aligned with both the center of the band gap and the resonance. Although this may be preferred it is not required. In general, all that is required is for the overlap between the acoustic wave and the resonance to concentrate enough energy to initiate detonation. Either the dominant frequency or the resonance may be positioned elsewhere within the band gap.

The center of the band gap is approximately the spacing 'd' of the periodic array. This spacing may range from as small as approximately 1 micron to as large as approximately 1 cm depending upon the materials in the periodic array. The material will produce a shock velocity with a certain band of excited modes. The major modes will determine the dominant frequency of the wave. The spacing of the periodic array is set at approximately the major wavelength (or at least on the order of) to center the dominant frequency of the acoustic wave in the band gap. The advantage of a large spacing "d" is that the periodic structures are simpler to fabricate.

In an embodiment, "but for" the periodic structure of the acoustic crystal explosive and particularly the defect cavity, the energy and intensity of wave 54 would be insufficient to detonate the explosive material. This may provide for the use of sources that generate relatively weak shock waves or even acoustic waves that are not shock waves. This may also provide for the direct initiation of secondary explosives. In other embodiments in which the primary objective is to use the periodic structure and defect cavities to produce volumetric, shape-charge or safe & arm detonation, the source may produce a wave 54 with either sufficient or insufficient energy and intensity to initiate detonation of the explosive material without the periodic structure and resonance. In other words, a source that produces a strong shock wave can be used. The band gap will suppress the strong shock wave from initiating detonation throughout the explosive material and concentrate the energy at the defect cavity(ies) for controlled detonation.

Figure 7:
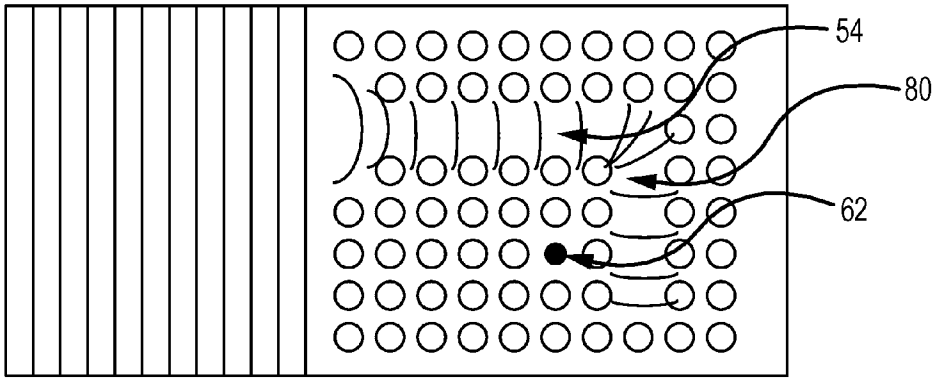
FIG. 7 is an embodiment of an acoustic crystal explosive including a waveguide for routing the source wave to the defect cavity.
Figure 8:
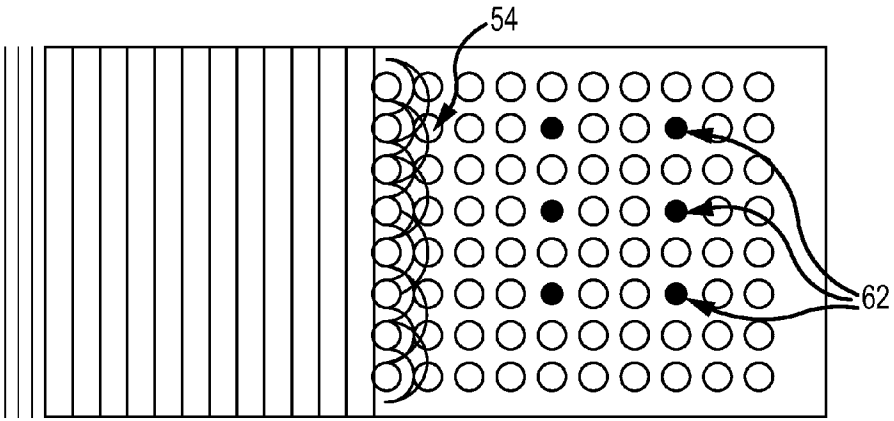
FIG. 8 is an embodiment of an acoustic crystal explosive including multiple defect cavities for volumetric detonation.

As shown in FIG. 7, in an embodiment a low-loss waveguide 80 in the periodic array guides acoustic wave 54 to defect cavity 62 to initiate detonation. Waveguides facilitate directing the shock wave to distant detonation points without triggering the explosive at points in between. This provides for control of both the direction and distribution of the detonation. As shown in FIG. 8, in an embodiment a plurality of defect cavities 62 are arranged throughout the periodic array. The defect cavities 62 will concentrate energy from the acoustic wave 54 to initiate detonation in multiple locations almost simultaneously. This has the benefit of producing a volumetric detonation. Multiple defect cavities and waveguides may be combined to produce a sequenced multi-point detonation.

Figure 9:
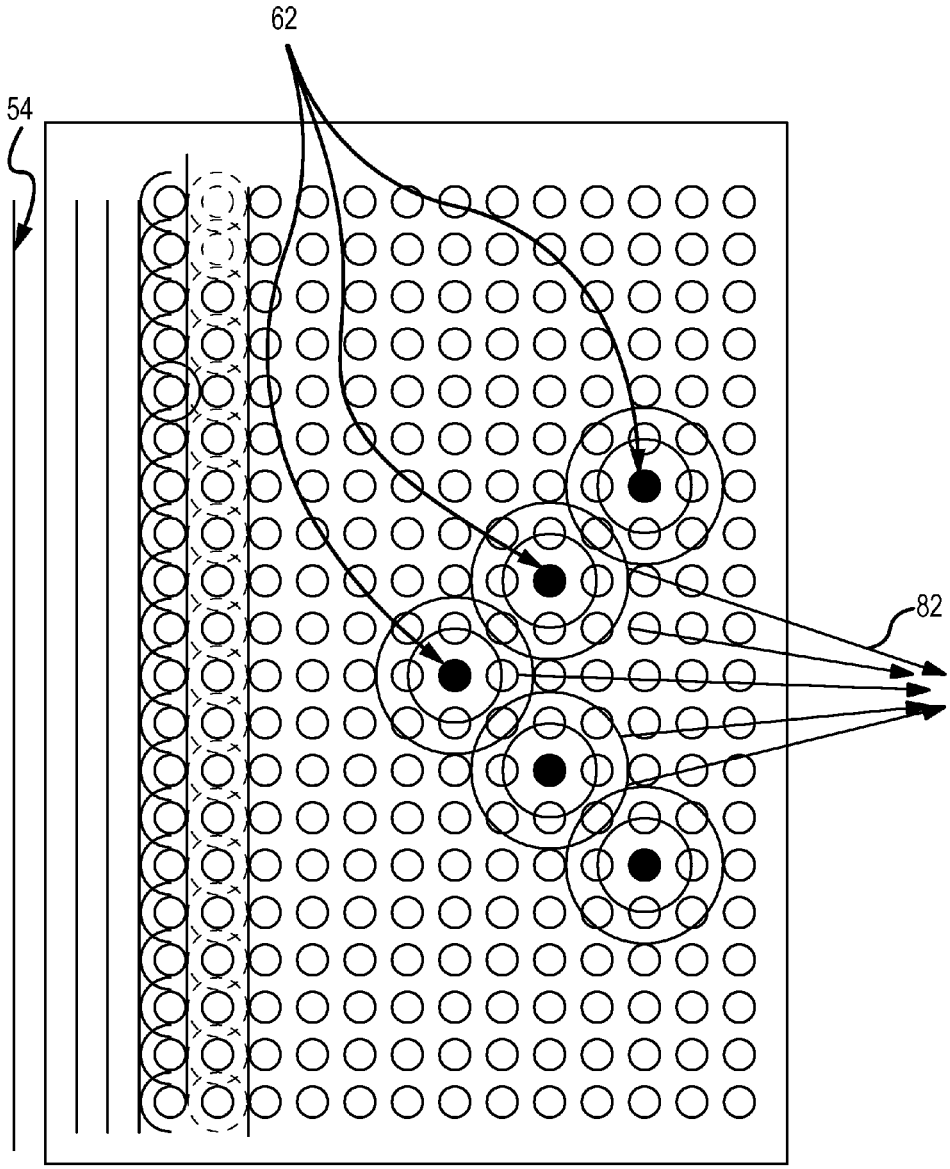
FIG. 9 is an embodiment of an acoustic crystal explosive including multiple defect cavities to produce a shaped charge detonation.

As shown in FIG. 9, in an embodiment a plurality of defect cavities 62 are arranged in the periodic array to produce a shaped-charge detonation 82. As shown in FIGS. 10*a*-10*b* and 11*a*-11*c*, in an embodiment an acoustic crystal explosive 90 may be configured and provided with the means to reprogram cites of defect cavities to produce a safe & arm device with single, multi-point, volumetric or shaped-charged detonation. The explosive could be reprogrammed prior to deployment, prior to launch, at launch, in flight or during terminal guidance.

Figure 11A:
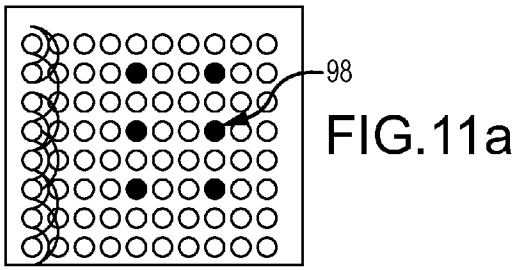
FIGS. 11*a* through 11*c* are plan views of the programmed acoustic crystal explosive for volumetric detonation and different shaped-charge detonations.
Figure 11B:
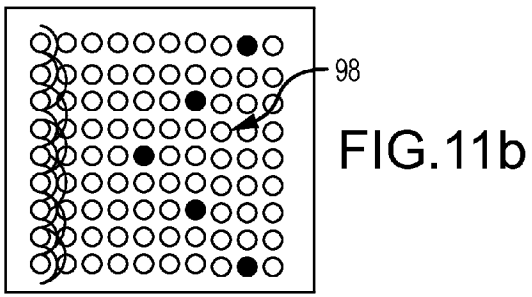
Figure 11C:
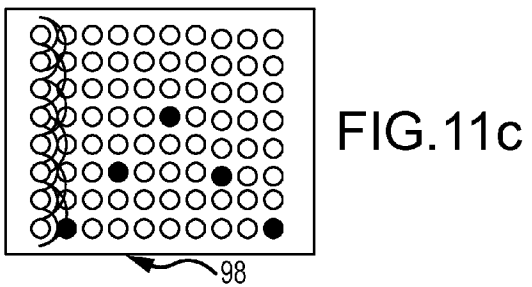
Figure 10A:
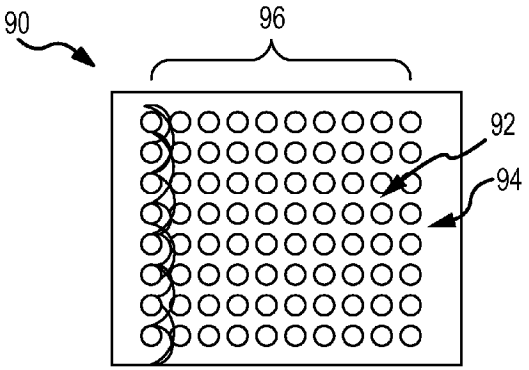
FIGS. 10*a*-10*b* are plan and side views of a programmable acoustic crystal explosive.
Figure 10B:
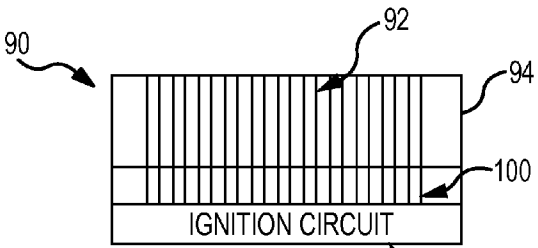

Acoustic crystal explosive 90 includes an explosive material 92 having a first acoustic index and a medium 94 having a second acoustic index different than said first acoustic index. The explosive material 92 and medium 94 are arranged in a periodic array 96 that provides local contrast modulation of the acoustic index of the explosive in at least one dimension. A local contrast modulation creates a 'band gap' in the acoustic transmission spectrum. In this particular embodiment, medium 94 is a slab of glass formed with a periodic array of holes that form the sites for the explosive material. Explosive material 92 albeit a solid, liquid or gas can be removed from these cites thereby forming a defect cavity 98. The defect may be formed by air in place of the explosive or by replacing the explosive material with a different material e.g. a different explosive material, an in active material with a different acoustic index with rods of index matching glass. In this particular embodiment, the acoustic crystal explosive is placed on top of a matching array of compressed air canisters 100 that are individually activated by an ignition circuit 102. The circuit triggers specific canisters that released compressed gas to pop the explosive material out of its site in the glass slab. As shown in FIG. 11*a*, six sites are activated to form six defect cavities 98 to effect volumetric detonation. As shown in FIGS. 11*b* and 11*c*, five sites are activated to form eight defect cavities 98 in the form of a shaped-charge oriented in different directions. A side-benefit to this approach is that until the circuit activates the defect cavities the acoustic crystal explosive is in suppression-mode, relatively immune to accidental or malicious detonation from an external shockwave. Reprogramming in this manner allows a generic acoustic crystal explosive to be stock-piled and then configured based on mission needs. The explosive may be reprogrammed in-flight to produce a desired shaped-charge.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An explosive configured to suppress accidental or malicious detonation in response to an external acoustic wave, comprising:

an explosive material having a first acoustic index; and a medium having a second acoustic index different than said first acoustic index, said explosive material and said medium arranged in a periodic array that provides local contrast modulation of the acoustic index of the explosive in at least one dimension that defines a band gap in the acoustic transmission spectrum of the explosive material that overlaps the frequency content of the external acoustic wave so that energy in the external acoustic wave is suppressed in the band gap and in a suppression mode does not detonate the explosive material.

2. The explosive of claim 1, wherein the contrast modulation is at least 1.5.

3. The explosive of claim 1, wherein the medium comprises a non-explosive material.

4. The explosive of claim 1, wherein the medium comprises a different explosive material.

5. The explosive of claim 1, wherein the explosive material is a secondary explosive.

6. The explosive of claim 1, wherein the spacing of the periodic array is no greater than 1 cm.

7. The explosive of claim 1, wherein the spacing of the periodic array is equal to a major wavelength of a dominant frequency of the external acoustic wave operatively coupled to the periodic array, said dominant frequency approximately centered in the band gap so that energy in the external acoustic wave is suppressed in the band gap.

8. The explosive of claim 6, wherein the medium is non-explosive material, further comprising a second non-explosive material that forms at least the first two external rows around the periodic array in place of the explosive material.

9. The explosive of claim 1, further comprising:

means to reconfigure the periodic array to introduce at least one defect cavity in the periodic array that creates a resonance in the band gap to switch from the suppression mode to an enhancement mode in which said defect cavity operatively couples and concentrates energy of the external acoustic wave to detonate the explosive material.

10. The explosive of claim 9, wherein said means to reconfigure the periodic array comprises an ignition circuit configured to selectively remove material from the periodic array to introduce said at least one defect cavity.

11. An explosive configured to enhance detonation in response to an external acoustic wave, comprising:

an explosive material having a first acoustic index;

a medium having a second acoustic index different than said first acoustic index, said explosive material and said medium arranged in a periodic array that provides local contrast modulation of the acoustic index of the explosive in at least one dimension, said modulation defining a band gap in the acoustic transmission spectrum of the explosive material that overlaps the frequency content of the external acoustic wave; and at least one defect cavity in the periodic array that creates a resonance in the band gap that overlaps the frequency content of the external acoustic wave, said periodic array configured to operatively couple the external acoustic wave into the array, said defect cavity concentrating energy in the external acoustic wave to detonate the explosive material.

12. The explosive of claim 1, wherein the contrast modulation is at least 1.5.

13. The explosive of claim 11, wherein the second medium comprises a non-explosive material.

14. The explosive of claim 11, wherein the second medium comprises a different explosive material.

15. The explosive of claim 11, wherein the explosive material is a secondary explosive.

16. The explosive of claim 11, comprising a plurality of defect cavities in the periodic array.

17. The explosive of claim 16, wherein the plurality of defect cavities are arranged to produce a volumetric detonation of the explosive material.

18. The explosive of claim 16, wherein the plurality of defect cavities are arranged in a pattern to produce a shaped charge detonation.

19. The explosive of claim 16, further comprising:

means to reprogram said plurality of defect cavities to control the direction or shape of the explosive detonation.

20. The explosive of claim 19, wherein in a suppression mode the periodic array contains no defect cavities and in an enhancement mode said means reprograms multiple locations in the periodic array to introduce the plurality of defects.

21. The explosive of claim 11, wherein in an enhancement mode said periodic array includes said at least one defect cavity and in a suppression mode the periodic array includes no defect cavity, further comprising:

means to reprogram the periodic array to introduce the at least one defect cavity to switch the explosive from suppression to enhancement mode.

22. The explosive of claim 11, further comprising:

a source of the external acoustic wave.

23. The explosive of claim 22, wherein absent the at least one defect cavity the acoustic wave is not strong enough to detonate the explosive material.

24. The explosive of claim 22, wherein the dominant frequency is approximately centered in the band gap.

25. The explosive of claim 22, wherein the dominant frequency is approximately coincident with the resonance of the defect cavity.

26. The explosive of claim 22, wherein the acoustic wave generated by the source is a shock wave.

27. The explosive of claim 11, wherein the spacing of the periodic array is no greater than 1 cm.

28. The explosive of claim 11, wherein the spacing of the periodic array is equal to a major wavelength of a dominant frequency of the external acoustic wave operatively coupled to the periodic array, said dominant frequency overlapping the band gap and the resonance of the defect cavity.

29. An explosive, comprising:

a source of an external acoustic wave having a major wavelength of a dominant frequency; and an acoustic explosive comprising an explosive material having a first acoustic index and a medium having a second acoustic index different than said first acoustic index, said explosive material and said medium spaced in a periodic array with a spacing of no greater than 1 cm that provides local contrast modulation of the acoustic index of the explosive in at least one dimension, said local contrast modulation and spacing of the periodic array defining a band gap in the acoustic transmission spectrum of the explosive material that overlaps the dominant frequency of the external acoustic wave, said acoustic explosive further comprising at least one defect cavity in the periodic array that creates a transmission resonance in the band gap that concentrates energy from the external acoustic wave to detonate the explosive material.

30. The explosive of claim 20, wherein the spacing of the periodic array is equal to the major wavelength of the dominant frequency of the external acoustic wave operatively coupled to the periodic array, said dominant frequency overlapping the band gap and the resonance of the defect cavity.

31. An explosive, comprising:

an explosive material having a first acoustic index; and a medium having a second acoustic index different than said first acoustic index, said explosive material and said medium arranged in a periodic array with a spacing no greater than 1 cm that provides local contrast modulation of the acoustic index of the explosive in at least one dimension that defines a band gap in the acoustic transmission spectrum of the explosive material that overlaps the frequency content of an external shock wave operatively coupled into the periodic array.

* * * * *